US005518168A

United States Patent [19]

Mayer

[11] Patent Number: 5,518,168

[45] Date of Patent: May 21, 1996

[54] TAMPER RESISTANT COLLAPSIBLE CONTAINER

[75] Inventor: Evan G. Mayer, Wayne, N.J.

[73] Assignee: AMCO Folding Cartons, Inc., Towaco, N.J.

[21] Appl. No.: 468,535

[22] Filed: Jun. 6, 1995

[51] Int. Cl.[6] ..... B65D 5/43; B65D 5/56

[52] U.S. Cl. ..... 229/102; 206/807; 220/416; 229/107; 229/198.2

[58] Field of Search ..... 229/102, 107, 229/195, 198.2, 4.5; 220/416, 418; 206/807

[56] References Cited

U.S. PATENT DOCUMENTS

| | | | |
|---|---|---|---|
| 1,298,635 | 4/1919 | Allen | 229/102 |
| 1,545,771 | 7/1925 | Hout | 229/107 |
| 2,265,280 | 12/1941 | Groves | 229/195 |
| 2,512,602 | 6/1950 | Bell | 220/416 |
| 2,714,446 | 8/1955 | Gillam | 229/107 |
| 2,965,280 | 12/1960 | Miller | 229/195 |
| 3,003,678 | 10/1961 | Chase | 229/195 |
| 4,438,846 | 3/1984 | Stylianou | 229/148 |
| 4,479,588 | 10/1984 | Davis et al. | 220/416 |
| 4,846,394 | 7/1989 | Swanson | 229/195 |
| 4,887,764 | 12/1989 | Ogura | 229/102 |

FOREIGN PATENT DOCUMENTS

| | | | |
|---|---|---|---|
| 3741283 | 6/1989 | Germany | 229/4.5 |
| 1570958 | 6/1990 | U.S.S.R. | 229/195 |

*Primary Examiner*—Gary E. Elkins
*Attorney, Agent, or Firm*—William Squire

[57] ABSTRACT

A one piece paperboard blank has plurality of adjacent sections four of which are folded over at creases to form an inner container a wall of which is bonded to a section of an outer sleeve. The sleeve is wrapped about the inner container to form a cavity in which the inner container is located. Identical top and bottom flaps are each formed of an inner flap member integral with a side of the inner container bonded to an outer flap member integral with a section of the sleeve. A locking tab depends from each inner flap member and is interlocked to dust flaps of the inner container at the container top and bottom interior the flexible sleeve which assumes the shape of the abutting outer flap member. The sleeve is interlocked by locking tabs at the sleeve end and inserted into the side of the sleeve to preclude tab removal by tampering.

28 Claims, 10 Drawing Sheets

TAMPER RESISTANT COLLAPSIBLE CONTAINER

This invention relates to foldable collapsible containers, and more particularly, to containers, e.g., paperboard, which provide tampering evidence when opened.

Paperboard containers typically are folded from a flat blank and are formed with outer flaps at opposite ends. Locking tabs depend from the flaps at each end. A pair of dust cover inner flaps overlie the container cavity at each end of the container. The locking tabs have slits which permit the tabs to interlock with the inner flaps to hold the outer flaps secured to the container in the closed condition. Generally such containers are in wide use and are commercially successful.

However, for certain goods such as costly cosmetics and the like, it is desirable to secure the goods to the containers reliably. Often, such containers are wrapped further in a clear or decorative wrap to provide tamper evidence that the container has been opened. This is to ensure that the goods are not removed from the containers by a tamperer. This outer wrapping is necessary because the prior art interlocking tabs are not tamper resistant. By manipulation of the container, i.e., pressing and deflecting the container walls and inserting a tool or finger into the interlock region, the interlock arrangement can be disengaged without damaging the container or flaps. In this way a tamperer can remove the contents of the container and reattach the interlocking tabs. This would be generally undetectable by visual observation of the container.

The present inventor recognizes a need for an attractive container, i.e., paperboard, for securing articles and for providing tamper resistance to the container so that any attempt to remove the contents of the container would damage the container. This would provide visual evidence of the tampering.

A tamper resistant container according to the present invention comprises a single piece folded sheet material container having a cavity and at least one open end for receiving an article in the cavity. Flap means are formed from the sheet material including first interlock means having open and closed locked states for locking attachment to the container to enclose the cavity in the closed state such that the flap means is damaged when the flap means is opened from the locked state to provide tamper resistance.

In one embodiment, an outer sleeve surrounds the container and further interlock means are provided formed from the sheet material secured to the sleeve for locking the sleeve to itself and for passing into the cavity to provide tamper resistance.

In a further embodiment, the flap means comprises a flap having an outer edge shape for engaging and conforming the sleeve to the outer shape, the first interlock means comprising a locking tab depending from the flap spaced from the outer edge for interlocking with the container.

In a still further embodiment, a foldable tamper resistant container comprises an inner sheet material container forming an article receiving cavity, the container having opposing ends, at least one of which ends is open and in communication with the cavity. An outer flexible sheet material sleeve surrounds and is secured to the inner container and forms an annular rim at the at least one end. A first flap having a peripheral edge is foldably secured to the sleeve at the one end, the flap edge for engaging and shaping the rim at the at least one end. A first locking tab foldably depends from the first flap at a region spaced from the flap peripheral edge for locking engagement with the inner container in the cavity.

In a further embodiment, the sleeve includes a second locking tab foldably secured to the sleeve for locking engagement with the sleeve about the inner container medially the inner container ends.

IN THE DRAWING

Figure 1:
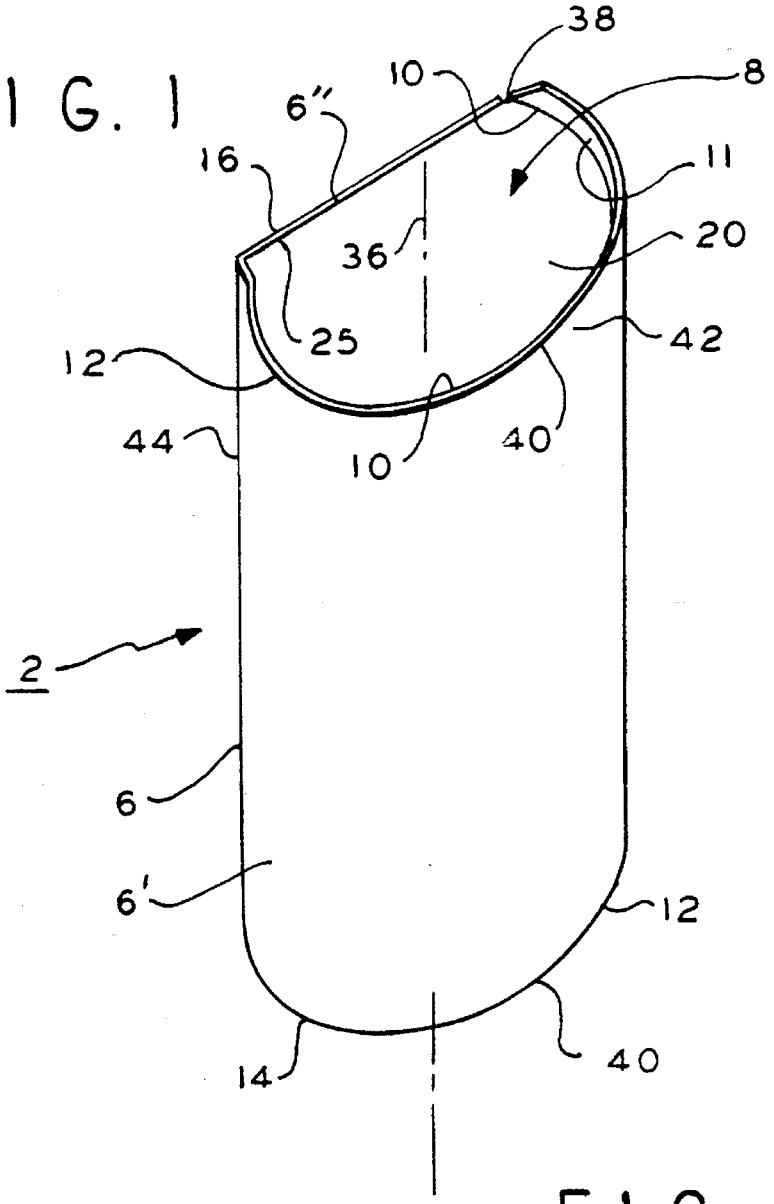
FIG. 1 is an isometric view of a container according to one embodiment of the present invention.
Figure 3:
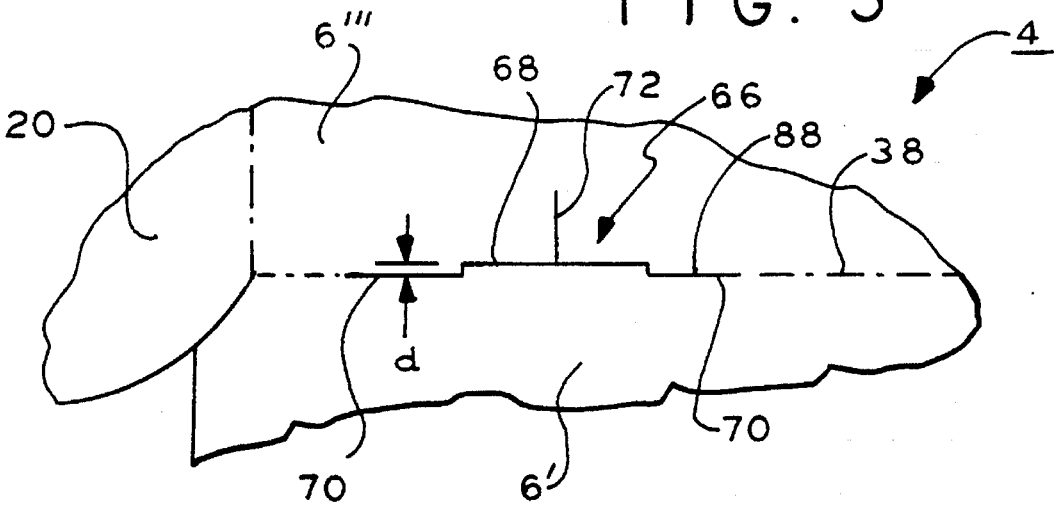
Figure 2:
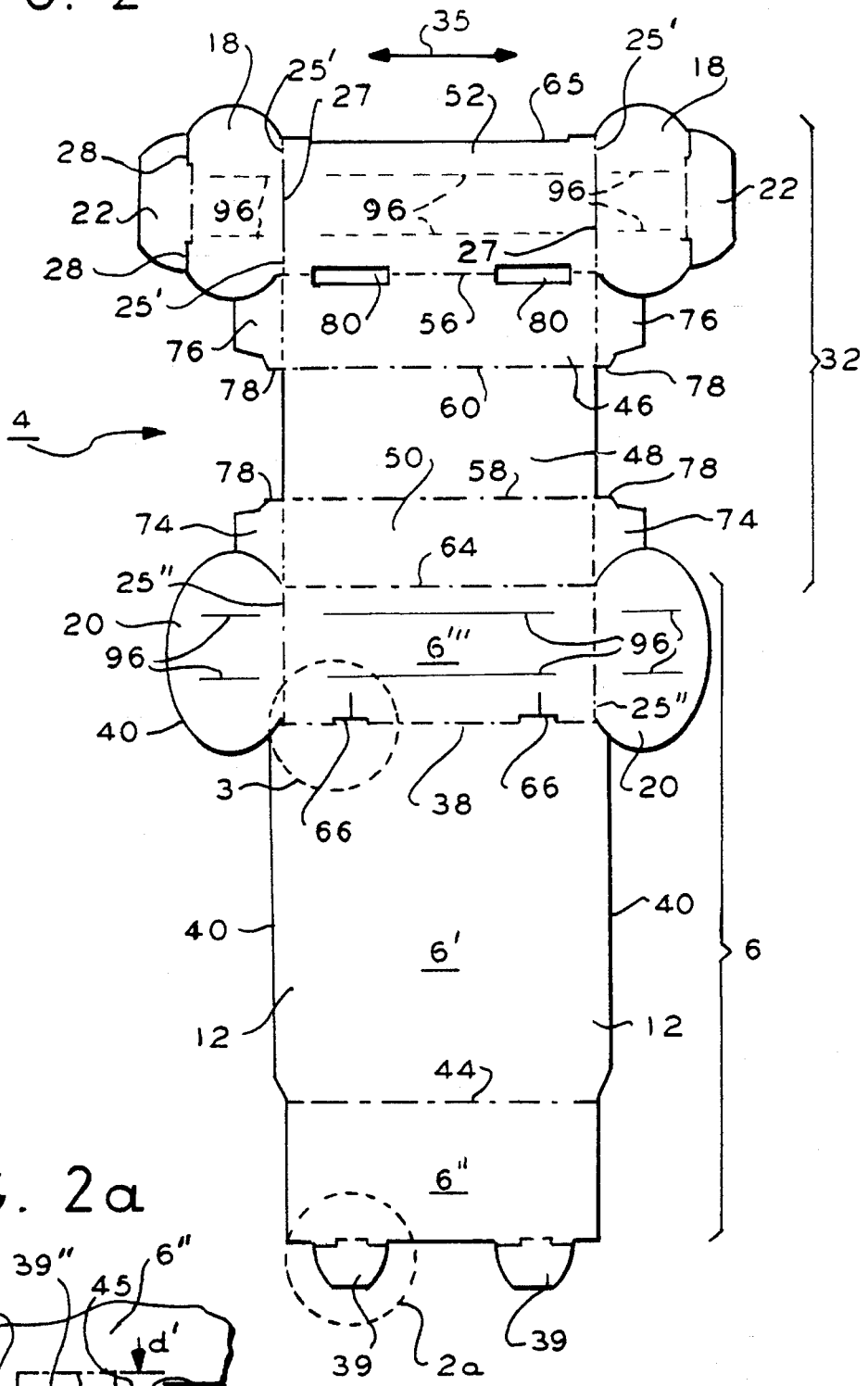
FIG. 2 is a plan view of a blank used to form the container of FIG. 1.
Figure 2A:
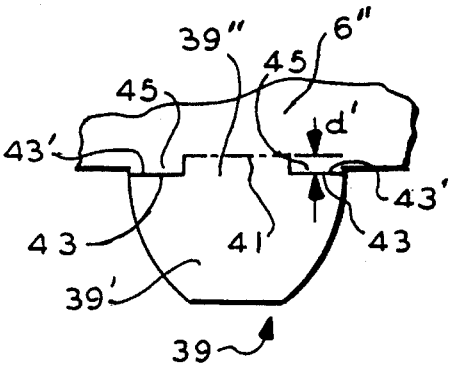
Figure 4:
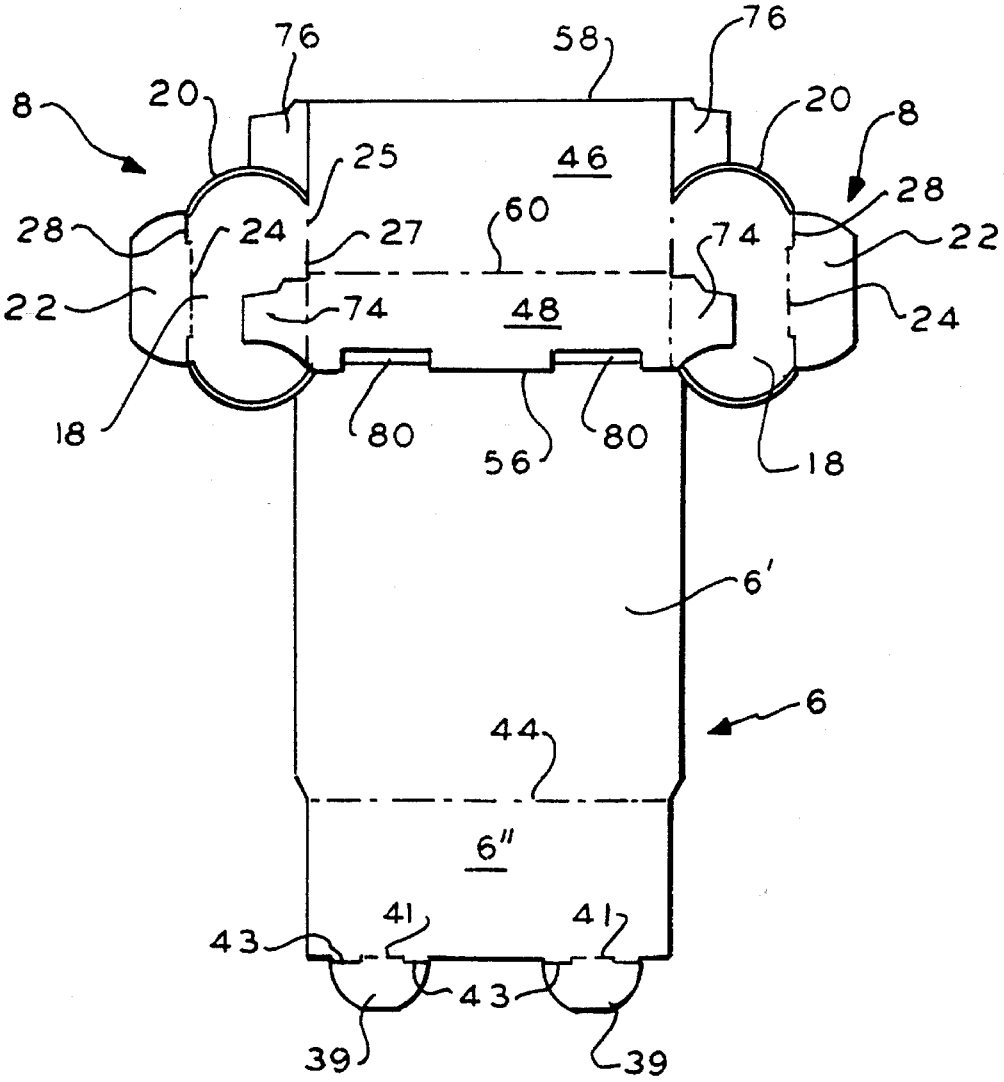
Figure 2B:
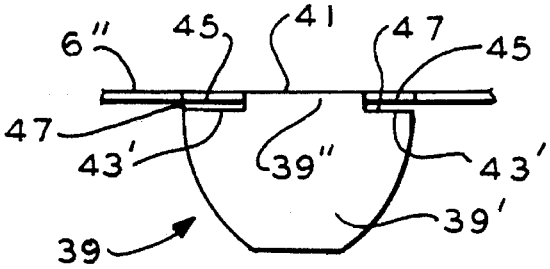
Figure 5:
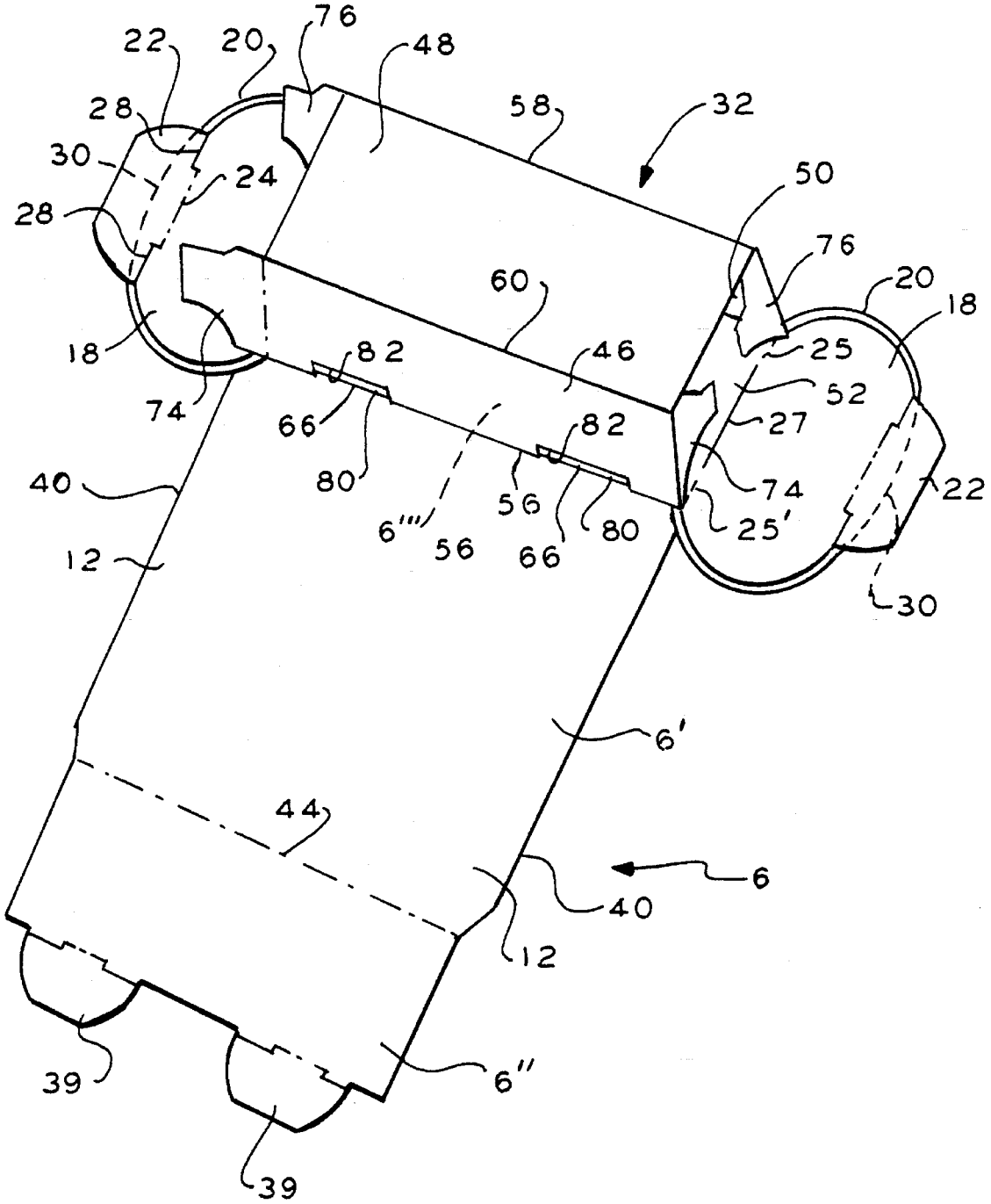
Figure 6:
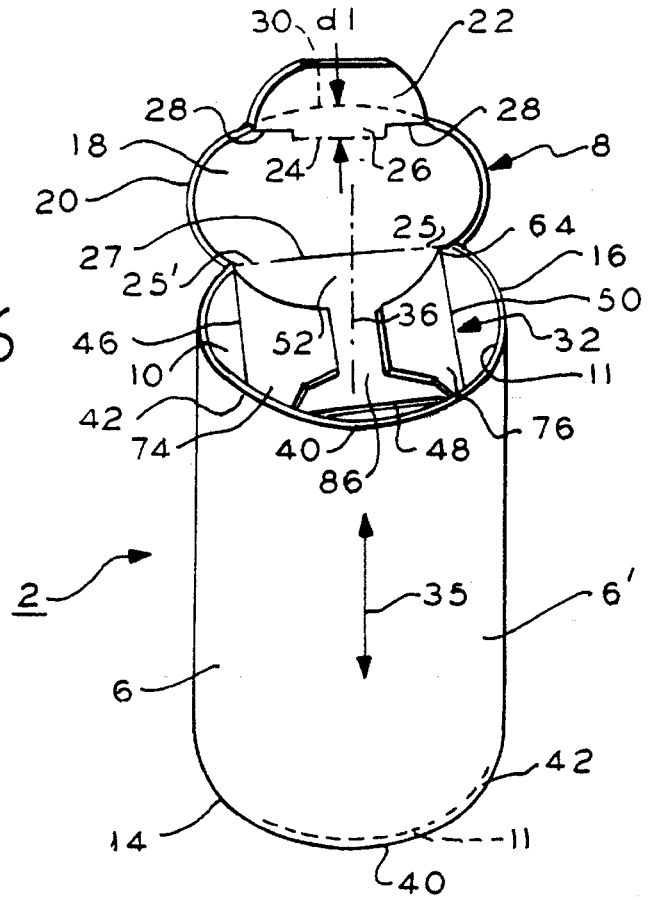
Figure 7:
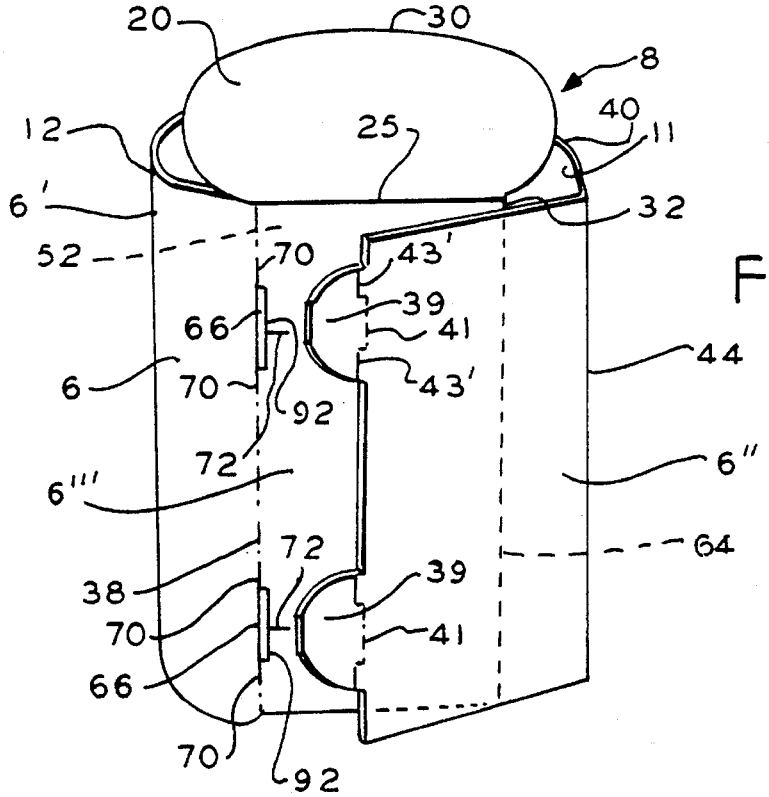
Figure 8B:
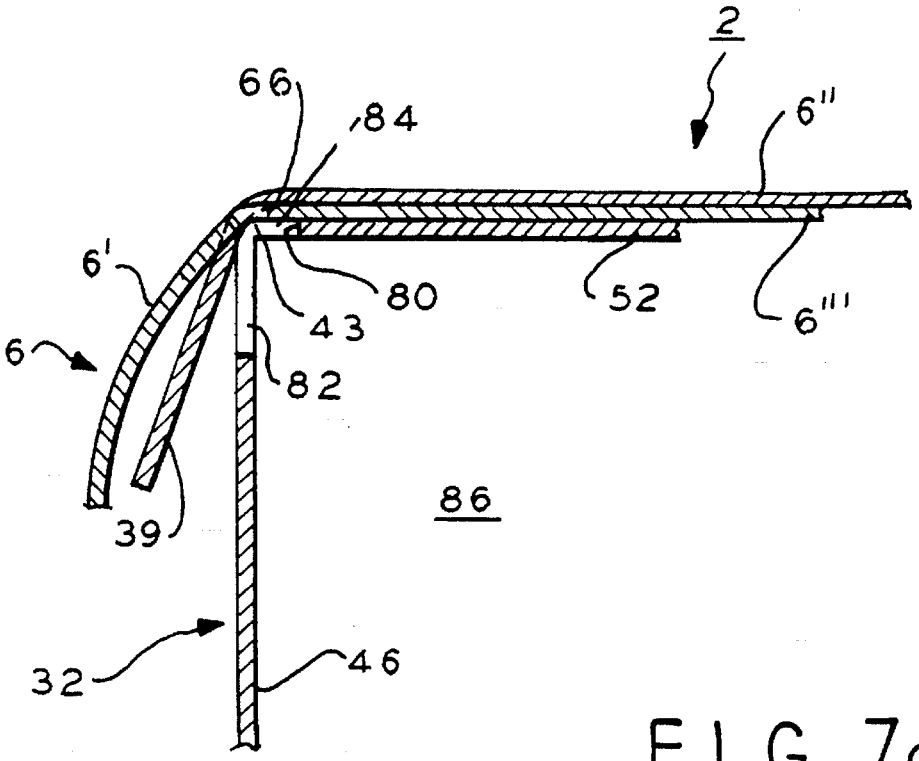
Figure 7A:
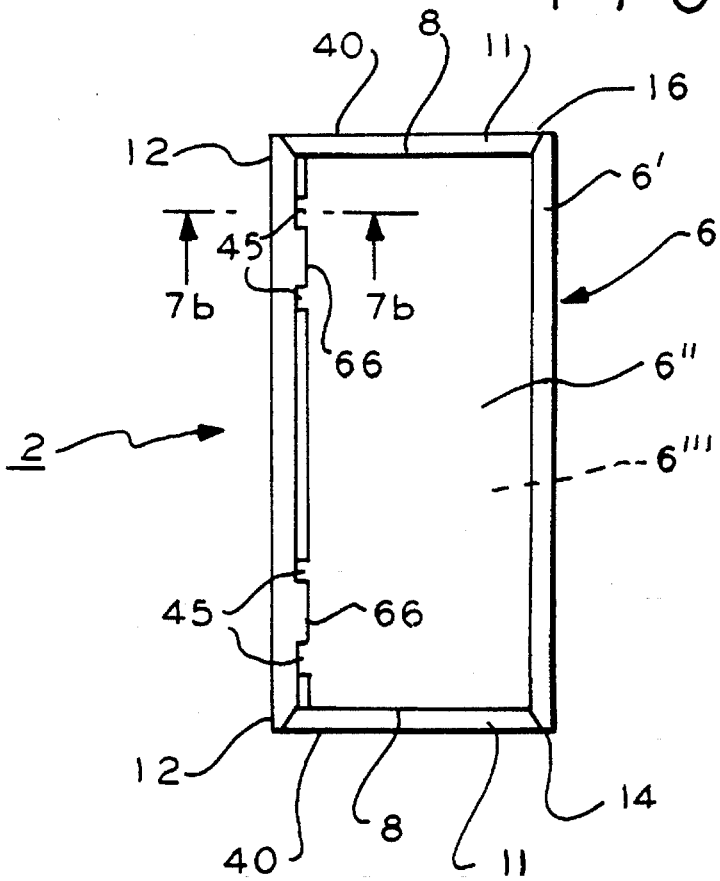
Figure 8:
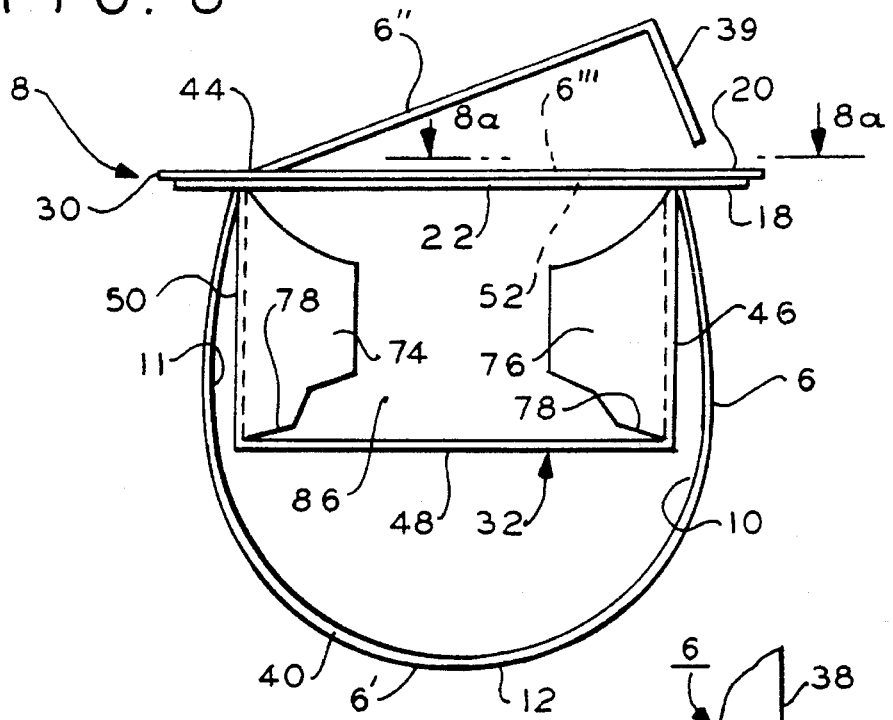
Figure 8A:
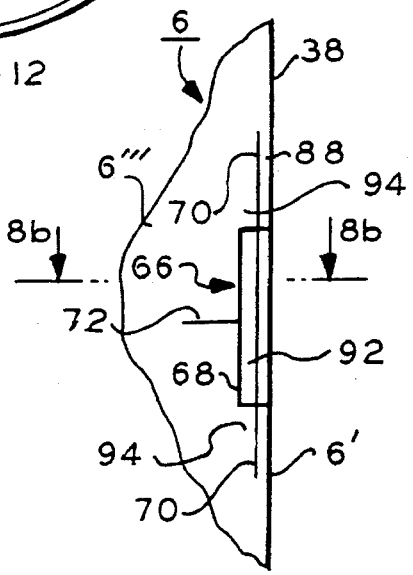

FIG. 2*a* is a plan view of a portion of the blank of FIG. 2 taken in region 2*a* showing a locking tab;

FIG. 2*b* is an end view of the tab of FIG. 2*a* after the tab is bent at its fold line;

FIG. 3 is an enlarged view of the encircled portion of FIG. 2 taken in region 3 showing an interlocking slot;

FIG. 4 is a plan view of the embodiment of FIG. 2 at a later stage of forming the container of FIG. 1;

FIG. 5 is an isometric view of the embodiment of FIG. 4 in a subsequent stage of processing;

FIG. 6 is an isometric view of the embodiment of FIG. 5 shown in a later stage of assembly open for receiving an article;

FIG. 7 is a rear elevation view of the container of the present invention in a subsequent stage of assembly from that of FIG. 5;

FIG. 7*a* is a rear elevation view of the embodiment of FIG. 1 showing the interlocking tabs of the sleeve in locking engagement;

FIG. 8 is an plan view of the container of FIG. 7 with the upper flap in an upright orientation;

FIG. 8*a* is a fragmented side elevation view of a portion of the rear side of the container of FIG. 8 taken along lines 8*a*–8*a;*

Figure 9:
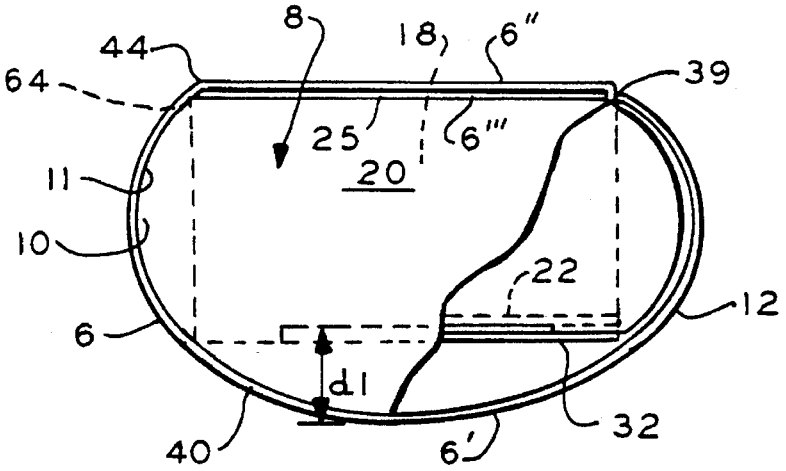

FIG. 8*b* is a fragmented sectional plan view of the embodiment of FIG. 8*a* taken along lines 8*b*–8*b* showing a received sleeve locking tab;

FIG. 9 is a bottom plan view partially broken away of the container of FIG. 7*a;*

Figure 10:
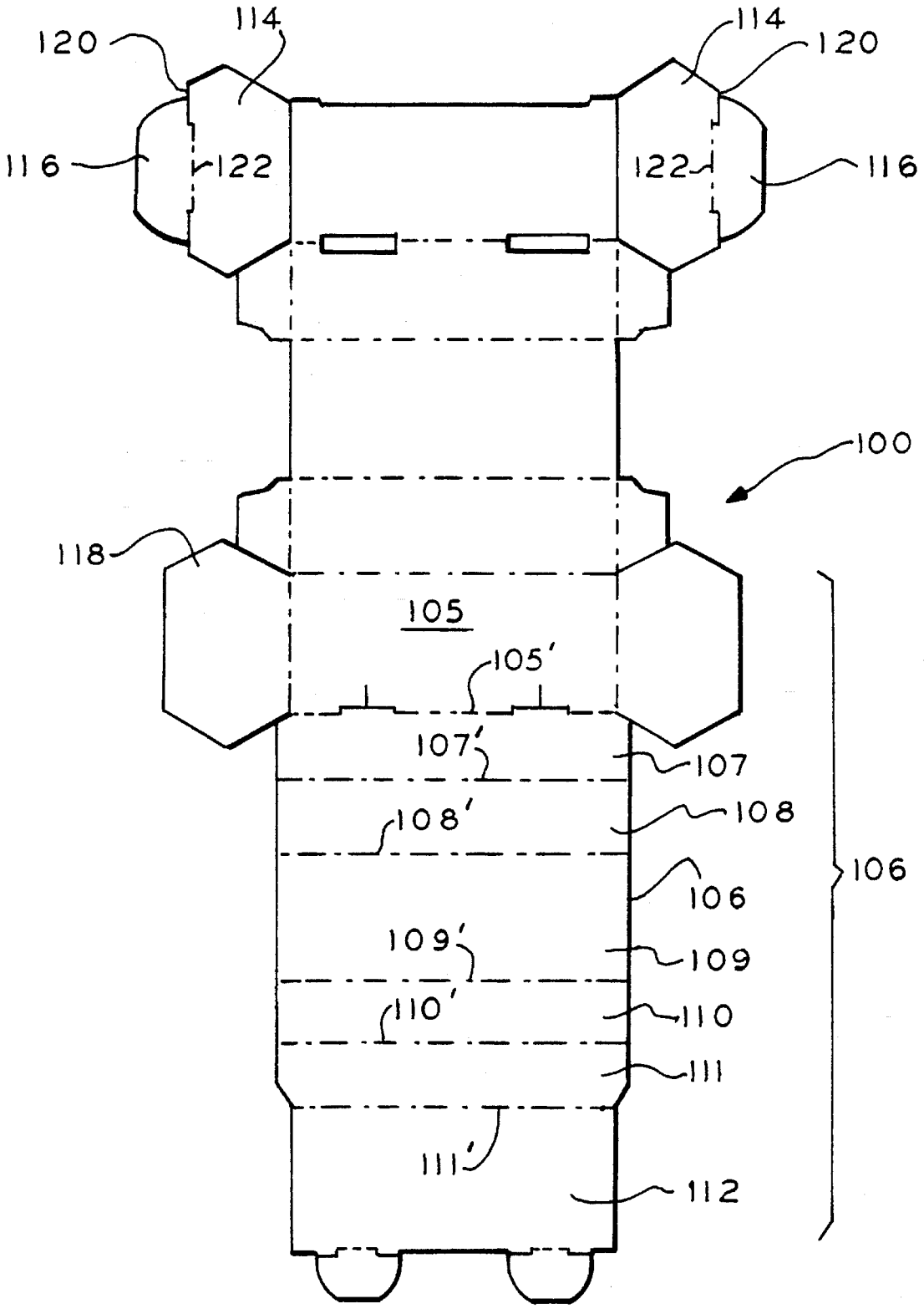
Figure 11:
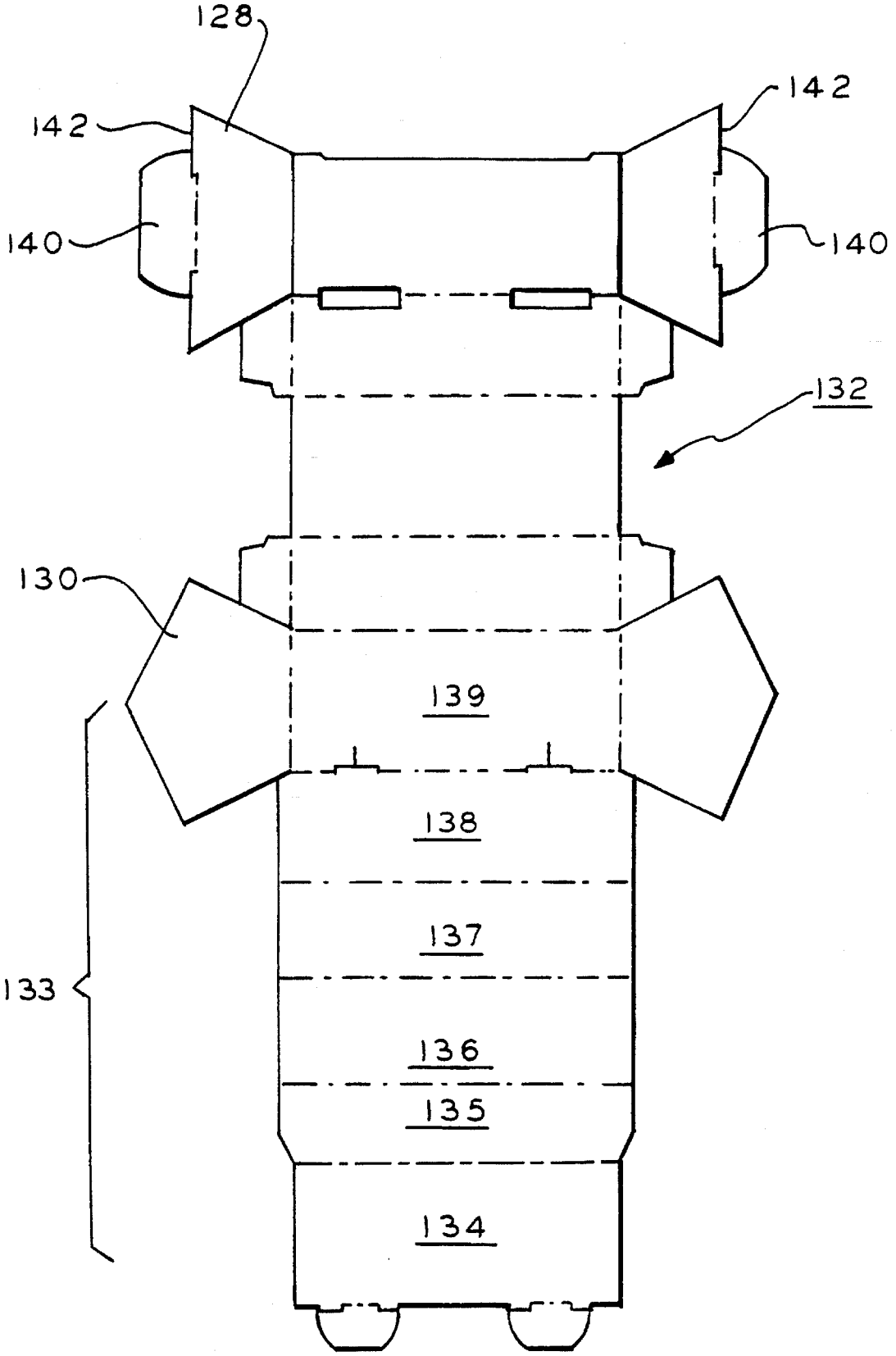
Figure 12:
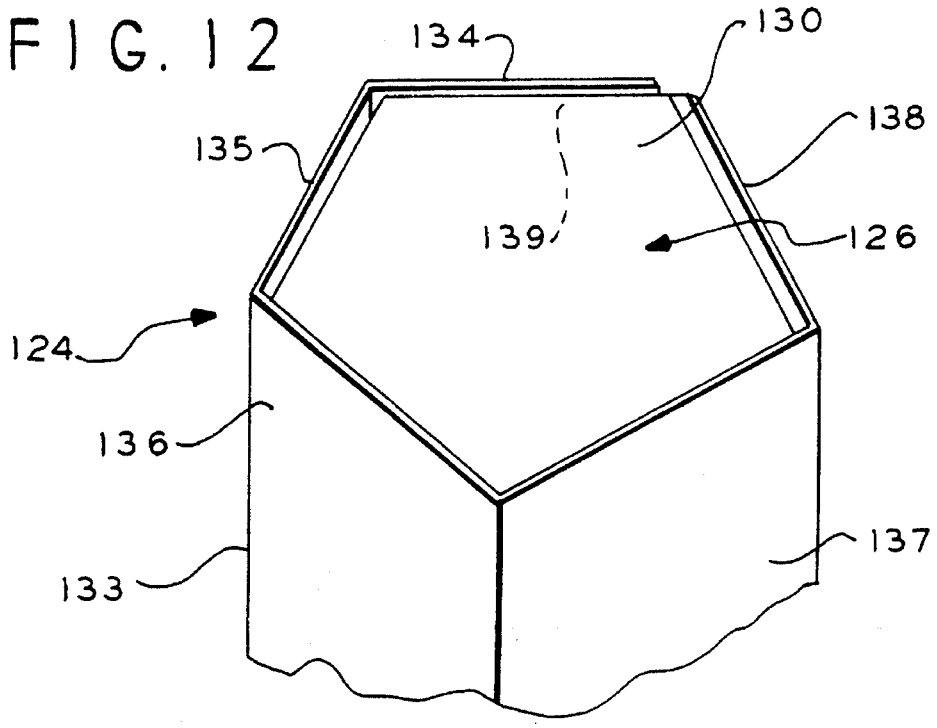
Figure 13:
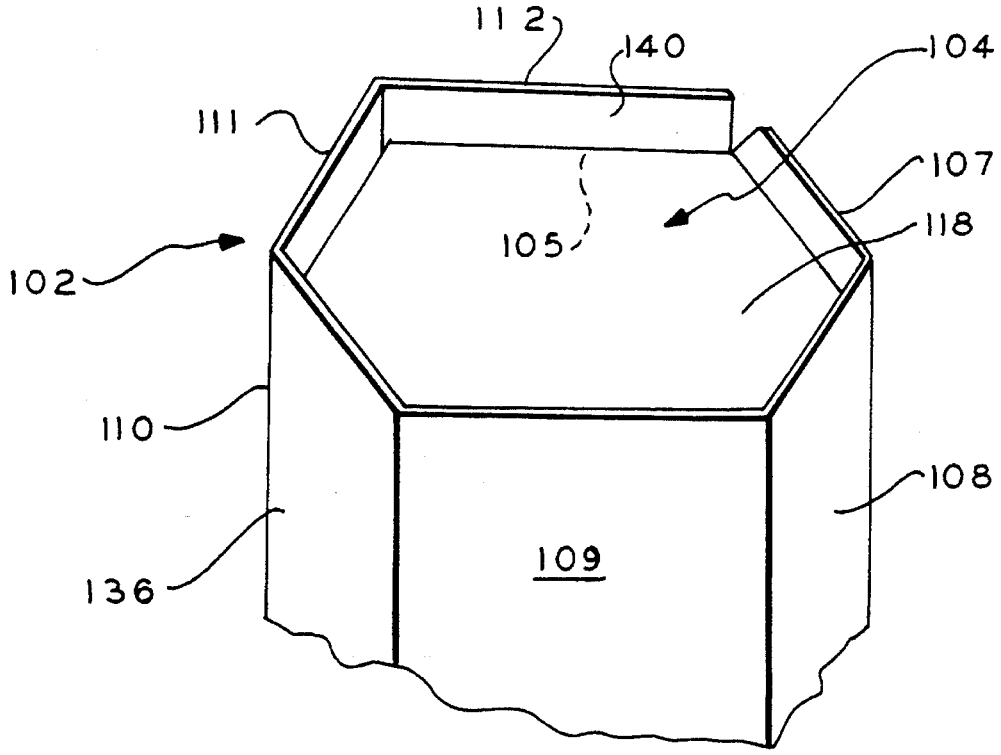

FIG. 10 is a plan view of a blank used to form a container according to a second embodiment of the present invention;

FIG. 11 is a plan view of a blank used to form a container according to a third embodiment of the present invention;

FIG. 12 is a fragmented partial view of the assembled closed container formed from the blank of FIG. 11; and FIG. 13 is a fragmented partial view of the assembled closed container formed from the blank of FIG. 10.

The container 2, FIG. 1, is formed from a single blank 4, FIG. 2, preferably single ply paperboard. Other materials such as corrugated paperboard or thermoplastic or other stiff sheet materials may also be used. Also, in the alternative, according to a given implementation, the container may be molded thermoplastic material as explained in more detail below. The container 2, FIG. 1, has an outer sleeve 6 and two identical end flaps 8 (one being shown in FIG. 1) secured to the sleeve 6. Each end flap 8 is recessed in a recess 11 in sleeve cavity 10 formed by sleeve rim 12 at the respective container top and bottom ends. The bottom end 14 of the container 2 is identical to the top end 16 and includes a further flap 8 (not shown in FIG. 1). Each end flap 8 includes a locking tab 22 (FIG. 6) that is interlocked as will be described so that the flap 8 can not be opened to the state shown in FIG. 6 without tearing.

Representative flap 8, FIG. 6, comprises an inner flap member 18 and an outer flap member 20. The inner and outer flap members are bonded with an adhesive (not shown in this figure). Locking tab 22 is foldable at crease fold line hinge 24 to an edge of inner flap member 18. The tab 22 is T-shaped with a relatively narrow leg 26 formed by cuts 28. The tab 22 is foldable at hinge 24.

In the various drawing figures broken lines such as at tab 22 hinge 24 represent a crease forming a fold hinge and solid lines in the material represent cuts in the blank, such as cuts 28. The cuts 28 are L-shaped with a major portion parallel to and lying on a line spaced from hinge 24 and a minor portion normal thereto. The hinge 24 is spaced from edge 30 of outer flap member 20 distance d1, FIG. 6.

The flap members 18 and 20 forming flap 8 are generally oval in plan view except for a straight portion at combined hinge 25. Hinge 25 hinges the flap 8 to overlying sleeve section 6''' and inner container 32 side wall 52. The flap members 18 and 20 may have other shapes as discussed below in connection with other embodiments. The inner flap member 18 is of generally the same shape as the outer flap member 20 but of smaller transverse dimensions as shown. Further, the inner flap member 18 differs from the outer flap member in that the inner flap member 18 has tab 22 depending therefrom at hinge 24. The location of the hinge 24 is somewhat interior the outer flap member 20 distance d1 from edge 30 for important purposes for providing tamper resistance as will be explained below.

The flap 8 hinge 25, FIGS. 2 and 6, is a combined hinge for both the bonded inner and outer flap members 18 and 20, respectively. The inner flap 18 has a central cut 27 aligned with opposing hinge creases 25' forming hinge 25. The outer flap 20 has a hinge crease 25'', FIG. 2, which overlies the cut 27 and creases 25' forming the combined hinge 25.

The sleeve 6, FIG. 7, comprises a rounded section 6' and overlying planar sections 6'' and 6'''. Section 6'' extends from section 6' at hinge 44 and section 6''' extends from section 6' at hinge 38. A pair of like locking tabs 39 are hinged to section 6''.

A representative tab 39 comprises, FIG. 2*a*, a main tab portion 39' and a leg 39''. The leg is hinged to section 6'' by hinge 41. The hinge 41 lies on a line spaced from cuts 43 distance d' forming a locking shoulder 43' in the tab 39. In FIG. 2*b*, the bent over tab 39 shoulders 43' are thus spaced from section 6'' projections 45 a locking gap 47.

The flap member 20, FIG. 2, is integral and one piece with section 6''' at hinge 25'' forming hinge 25 of flap 8 (FIG. 6). The sleeve 6 is flexible and is deformed into the partial oval shape of FIG. 1 when the flap 8 is placed into the recess 11. The flap 8 peripheral edge 30 abuts the inner surface of the sleeve 6 to form a tight fit therebetween shaping the sleeve 6 of the container 2. The flap 8 is held in the closed relationship of FIG. 1 by the interlocking of the tab 22 with the inner container 32 as will be described below.

A preferably rectangular or square in transverse shape inner container 32, FIGS. 6 and 8, is within the sleeve 6 cavity 10. The container 32 has a slightly smaller axial extent in the directions 35 of axis 36 than the sleeve 6. This forms the recess 11 at each end of the container 2.

The container 32 has four planar side walls 46, 48, 50 and 52, FIGS. 2, 6 and 8. The side walls 46–52 and the sleeve 6 are formed from a single piece sheet material wherein the inner container 32 corners are formed by fold creases. Wall 46 is connected to wall 52 by crease 56, FIG. 2, and to wall 48 by crease 60. Wall 48 is connected to wall 50 by crease 58 and wall 50 is connected to section 6''' by crease 64. The inner container 32 side walls all have the same axial extent as foreshortened planar section 6''' of the sleeve 6 (FIG. 7). Side wall 52 is substantially the same in size and shape as section 6''' of the sleeve 6 and bonded thereto by an adhesive. Thus, section 6''' and side wall 52 form a double wall thickness, FIG. 8*b*. The side wall 52, FIG. 2, has a recessed edge 65 to permit ease of folding the blank to form the inner container 32

In FIGS. 2 and 3, a pair of spaced stepped T-shaped cuts 66 are formed at the crease of the hinge 38 region of the blank 4. The cut 66 has a first linear cut 68 which is spaced distance d from a pair of spaced opposing coextensive linear cuts 70. Cuts 70 are on the crease forming hinge 38. Distance d is less than distance d', FIG. 2*a*, of the tab 39 and preferably about one half. The cut 68 includes a transverse cut 72. The cut 68 receives a tab 39, FIG. 7, which interlocks therewith at tab 39 shoulder 43, FIG. 8*b*, the cut 72 permitting bending of the material to permit easier insertion of the tab 39.

The container 32 includes a pair of mirror image dust flaps 74 and 76, FIGS. 6 and 8. The dust flaps 74 and 76 each have an edge 78 which interlocks with a shoulder of the tab 22 of flap 8 formed by cuts 28. The tab 22 shoulders interlock when the tab 22 is inserted between the dust flaps 76 and 78 and the container wall 48. The hinge 24 of the tab 22 being offset from the major portion of the cuts 28 causes the tab 22 shoulders formed by cuts 28 to be positioned underneath the dust flaps at edges 78 in interlocking engagement.

In similar fashion, the shoulders 43' of tabs 39, FIG. 7 interlock with the sleeve section 6''', FIG. 3, due to the offset distance d of the cut 68 from cuts 70. The offset causes the leg 39'' of the tab 39 to enter the slot formed by cut 68 and cause the shoulders of the tab 39 to interlock beneath the overlying region of section 6''' at distance d.

As best seen in FIG. 2, like rectangular openings 80 are formed in walls 46 and 52 aligned on crease 56. The openings 80 are offset asymmetrically with respect to crease 56. The major portion of the openings 80 are in wall 46. When the side walls are folded to form the inner container 32, FIG. 8*b*, the openings 80 each comprise separate, but contiguous opening 82 in wall 46 and opening 84 in wall 52. The opening 80 permits the tab 39 to be inserted in the space of cavity 10 between the inner carton 32 and the sleeve 6 so that the tab is exterior container 32 and interior sleeve 6.

In FIGS. 3 and 8*a*, the cuts 68 and 70 take the form shown when the sleeve 6 is folded at crease 38. When folded, the edge 88 of section 6' formed by cuts 70 is exposed. The cuts 68 and 70, when the adjacent sections are folded as in FIG. 8*a*, forman opening 92. The opening 92 receives the leg 39'' of the tab 39. Due to the tab 39 distance d', FIG. 2*a*, the tab portion 39' is located beneath section 6''', FIG. 8*a*, in region 94 adjacent to cuts 70. This interlocks the tab 39 shoulders 43' to regions 94.

A tamperer, however, can not displace the tab portion 39' to unlock the tab 39 without visibly damaging the adjacent material. In FIG. 8*b*, the tab 39 by being interior the inner container in cavity 86, resists tampering. This is because a tamperer can not directly access the tab 39 with finger or tool pressure by reason of the presence of the sleeve section 6'. Merely tugging on the tab 39 at sleeve section 6'', FIG. 7*a* does not release the tab 39. Tools are not easily inserted to release the tab 39 without damaging the container 2.

In FIG. 2*a*, the cuts 43 form projections 45. In FIG. 7*a*, the projections 45 cover the cuts 70 in the sleeve 6, FIG. 3, to resist tampering with tools. Any such tampering tends to damage the paperboard container material. The external appearance of the container 2 is enhanced with decorative coatings or labels, corresponding to relatively costly articles contained in the container 2, such as cosmetics and so on, which coatings and labels which are easily damaged and further provide evidence of tampering.

The flap 8 tabs 22 are also tamper resistant. Once the tabs 22 are interlocked with the dust covers 74 and 76 of the inner container 32, FIG. 6, the tab 22 is not directly accessible for tampering. This is because the tab 22 is spaced from the edge of the flap 8 distance d1, FIGS. 6 and 9. The outer flap member 20 covers the tab 22 and closely abuts the inner surface of the sleeve 6 rim 12 in recess 11. Because the tab 22 is displaced from this abutment of the flap 8 with the sleeve 6, a tortuous path is provided between the flap 8 interface with the sleeve 6 and the interior of the inner container 32 cavity 86. Unless the tabs 22 can be displaced to remove the interlock of their shoulders, the material will tear if an attempt is made to open the container 2 at any of the tabs 22.

The container 2 is fabricated as follows. In FIG. 2, the blank 4 is formed as described above. The blank is flat in the form illustrated in FIG. 2. A set of adhesive strips 96 are applied to the surfaces of walls 50 (exposed side in FIG. 2, solid lines) and 52 (underside in FIG. 2, dashed lines) and to flap members 18 and 20, as shown. The blank is then folded over at creases 56 and 58 so that wall 52 adhesive side abuts section 6''' adhesive side, FIG. 4. The adhesive strips 96 are then cured, bonding section 6''' to wall 52 forming the inner container 32, as shown in FIG. 5.

The next step in forming container 2, FIG. 7, comprises sealing the bottom of the container 2 by folding over bottom flap 8 and inserting the tab 22 at bottom end 14 to lock it to the inner container 32 flaps 74 and 76 so that the bottom end 14 appears as the top end 16, FIG. 1. The top end is open as shown in FIG. 6 for receiving an article. Next the sleeve 6 tabs 39 are inserted through the openings 92 and cuts 70, FIGS. 7, 8 and 8*a*. The tabs 39 are inserted into the cavity 10 of the sleeve 6 through the corner cutout region of inner container 32 formed by mating openings 80 in side walls 46 and 52, FIG. 8*b*. After an article is inserted into the inner cavity 86 through the open top flap 8, FIG. 6, the top flap 8 is closed, tab 22 thereof is locked to the inner carton 32. At this time the carton 2 is sealed and is relatively tamper resistant.

While a paperboard blank 4 is illustrated, it will occur that the blank may also be any other suitable sheet material. Further, the locking arrangement of the sleeve may be omitted and made more tamper resistant by using an adhesive in place of the locking arrangement of overlying wall 52 and sleeve section 6''' to bond the sleeve section 6'' in place. For example, the tabs 39 may be bonded to the inner surface of sleeve 6.

In a further embodiment, the container may be employed without the locking arrangement of the top and bottom flaps 8 by interlocking the overlying wall 52 and sleeve section 6''' with interlocking tabs instead of using an adhesive of the embodiment of FIG. 5. That is, wall 52 may have locking tabs (not shown) at edge 65, FIG. 2. Such tabs would be inserted into mating slots (not shown) in the junction between wall 50 and section 6''' at crease 64. These locking tabs would be internal the sleeve in cavity 10 and thus not accessible for tampering. Such tabs may also be bonded in the alternative.

Also, the top flaps are not essential in a further embodiment wherein the container comprises molded thermoplastic material with integral molded ends and no end flaps such as flaps 8. The interlocking sleeve would provide access for inserting an article within the inner container before it is formed by interlocking tabs. The sleeve in this case is preferably not bonded, but interconnected by locking tabs (not shown) in overlying relation. When the sleeve is locked in place, the inner tabs locking the overlying portions of the sleeve together would no longer be accessible for tampering.

In a further embodiment, the sleeve and inner container may be molded integral as one piece and one or both end flaps 8 employed for locking the ends after an article is inserted in the inner container cavity.

In a further embodiment, the sleeve locking tabs 39 may be interlocked with the inner container through locking slots (not shown) in the inner container corresponding to the location of the openings 80. Such locking slots may be in addition to the locking slots formed by cuts 66 in the sleeve 6.

FIG. 10 illustrates a blank 100 in a further embodiment which is similar to that of FIG. 2. The locking tabs, inner container and outer sleeve of the container 2 of FIG. 1 are generally formed by the blank 100 of FIG. 10. The difference is in the shape of the sleeve. The container 102 formed by the blank 100 is shown in FIG. 13. Container 100 has a top flap 104 and the sleeve 106 is hexagon in shape. The bottom flap (not shown) is identical to the top flap 104.

In FIG. 10, the sleeve 106 is formed by sections 105 through and including 112, separated by respective creases 105', 107', 108', 109', 110' and 111'. Representative top flap 104 is formed by inner flap member 114 having a tab 116 and outer flap member 118. Outer flap member 118 has the peripheral shape of the container 102 sleeve 106, FIG. 13. The inner flap member 114 is truncated at edge 120 from which tab 116 depends at crease 122. The inner container side walls may be the same shape and dimensions of the container 2, FIG. 1. The remaining portions of the blank 100 may be the same as the blank 4, FIG. 2.

FIGS. 11 and 12 illustrate a further embodiment. In FIG. 12 container 124 is a pentagon in plan view. The top and bottom flaps 126 have this pentagon shape. The top and bottom flaps are identical. The top flap 126 comprises an inner flap member 128 and an outer flap member 130. In FIG. 11, blank 132 is similar to the blank 4, FIG. 2, and blank 100, FIG. 10. The difference lies in the shape of the inner and outer flap members 128 and 130, respectively, and in the position of the creases and dimensions of the sleeve 133 sections 134, 135, 136. 137, 138, 139 and 140. Outer flap member 130 is pentagon in shape. Inner flap member 128 is trapezoidal. Locking tab 140 depends from edge 142 of member 128. The inner container is formed identically as described for the embodiments above, but may be of different dimensions, as may all embodiments.

While specific embodiments have been illustrated, these are given by way of example, and not limitation. It is intended that the scope of the invention is as defined in the amended claims.

What is claimed is:

1. A foldable tamper resistant container comprising:

an inner sheet material container forming an article receiving cavity, said container having opposing ends, at least one of which ends is open and in communication with the cavity;

an outer flexible sheet material sleeve surrounding and secured to the inner container and forming an annular rim at said at least one end;

a first flap having a peripheral edge and foldably secured to the sleeve at said one end, said flap edge for engaging and shaping the rim at said at least one end; and a first locking tab foldably depending from the first flap at a region spaced from said flap peripheral edge for locking engagement with said inner container in said cavity.

2. The container of claim 1 wherein said sleeve includes a second locking tab foldably secured to the sleeve for locking engagement with said sleeve in a region intermediate said inner container ends to secure the sleeve about the inner container.

3. The container of claim 2 wherein the sleeve has opposing ends, the sleeve being integral with and one piece with the inner container at one sleeve end, the other opposing sleeve end being free and including said second locking tab secured thereto for securing that free sleeve end to the sleeve in a region spaced from the free end to form a substantially continuous annular sleeve about said inner container.

4. The container of claim 1 wherein the container is open at both ends in communication with the inner container cavity, said sleeve forming an annular rim at both said container ends, further including a second flap having a peripheral edge and foldably secured to the sleeve at an end opposite said one end, said second flap for overlying said cavity and for engaging and shaping the rim at said opposite end and a third locking tab foldably depending from the second flap at a region spaced from said edge of the second flap for locking engagement with said inner container in said cavity at said opposite end.

5. The container of claim 1 wherein the sleeve and container are one piece formed from a single blank sheet material.

6. The container of claim 5 wherein the inner container and sleeve are paperboard.

7. The container of claim 4 wherein the sleeve forms a further cavity, the annular rim at each end being adjacent to a recess portion of said further cavity at the corresponding end, said flap edge of each flap abutting the corresponding rim within said recess portion such that that flap is recessed within said cavity.

8. The container of claim 1 wherein the inner container has at least one side wall, the inner container at said at least one end has a pair of further flaps foldably secured to said at least one side wall for overlying said cavity, said first locking tab and further flaps including means for interlocking in said cavity between said at least one side wall and said further flaps to preclude withdrawal of said first locking tab from said cavity.

9. The container of claim 2 wherein the inner container has at least one side wall having a first opening therein forming a corner cutout region, said sleeve being juxtaposed with said inner container and having a second opening therein aligned with the cutout region, the second locking tab for passing through said second opening and cutout region in the space between the sleeve and inner container and for interlocking with the sleeve at the second opening.

10. The container of claim 9 wherein the sleeve has a plurality of said second locking tabs in spaced relation, said inner container and sleeve each having a like plurality of said first and second openings, each second locking tab for passing into the space and for engaging and interlocking with the sleeve at a different corresponding aligned second opening and cutout region.

11. The container of claim 9 wherein the sleeve and inner container are a one piece integral sheet material formed from a single blank of sheet material.

12. The container of claim 1 wherein said inner container and sleeve have the same longitudinal axis, said inner container having at least one side wall extending parallel to the axis and forming said cavity with a given transverse shape along said axis, said sleeve having a different transverse shape than that of the inner container along the axis and spaced from at least a portion of said at least one side wall.

13. The container of claim 12 wherein the inner container is a polygon transverse the axis and the sleeve is generally rounded in at least a portion thereof in a direction transverse the axis.

14. The container of claim 12 wherein the inner container and sleeve are both polygons transverse the axis.

15. A foldable tamper resistant container comprising:

an inner sheet material container forming an article receiving cavity having open opposing first and second ends in communication with the cavity;

an outer flexible sheet material sleeve surrounding the inner container and forming an annular rim at each said ends;

a first flap having a peripheral edge and foldably secured to the sleeve at each said ends, each said flap for engaging and shaping the rim in a closed locked state;

a first locking tab foldably depending from the flap at a region spaced from said edge for locking engagement with said inner container in said cavity; and a second locking tab foldably secured to the sleeve for locking engagement with said sleeve at a region spaced from the second locking tab, said second tab being interior said sleeve in a region intermediate said ends to secure the sleeve about the inner container.

16. The container of claim 15 wherein the inner container and sleeve are formed from a single piece blank.

17. The container of claim 16 wherein the inner container has a plurality of side walls, one of said side walls being bonded to the sleeve.

18. The container of claim 17 wherein the first flap comprises first and second flap members one of which is external and the other internal adjacent to the inner container in the closed locked state, the flap members being secured to each other in overlying relation, said first locking tab being integral with and one piece with the internal one of said flap members at each said ends.

19. The container of claim 18 wherein the external flap member has a given shape, the internal flap member having at least a portion of said given shape.

20. The container of claim 15 wherein the sleeve is spaced from the container about a major portion of the container between said ends forming a further cavity.

21. A foldable tamper resistant container comprising:

an inner sheet material container forming an article receiving cavity of a given geometric transverse shape of first transverse dimensions and having open opposing first and second ends in communication with the cavity;

an outer sheet material sleeve surrounding the inner container and of a different transverse dimensions than the inner container, said outer sheet forming an annular rim coextensive with a recess at each said ends;

a flap foldably secured to the sleeve at each said ends, each said flap having a peripheral edge of a given shape of said different transverse dimensions in abutting relationship with the sleeve in said recess for conforming said sleeve to said given shape;

a first locking tab foldably depending from the flap at a region spaced from said peripheral edge for locking engagement with said inner container at a respective corresponding end and for securing that flap in said abutting relationship; and at least one second locking tab foldably secured to the sleeve for locking engagement with one of said sleeve and inner container to secure the sleeve about the container.

22. The container of claim 21 wherein the inner container has at least one side wall having a first opening therein, said sleeve being juxtaposed with said inner container and having a second opening therein aligned with the one side wall opening, the second locking tab for passing through said second opening adjacent to the first opening and for interlocking at least with the sleeve at said second opening.

23. The container of claim 22 wherein the first opening is defined by length and width dimensions, the second opening forming a slit having a substantially smaller width dimension than the first opening width dimension.

24. A tamper resistant container comprising:

a folded sheet material inner container having a cavity and at least one open end for receiving an article in the cavity;

flap means including first interlock means having an open state and a closed locked state for locking attachment to the container to close the cavity in the closed state;

an outer sleeve having opposing ends and surrounding the container; and means for securing the sleeve to the container;

the flap means comprising a first flap secured to the sleeve at one sleeve end and having an outer edge shaped to mate with the one sleeve end, said first interlock means comprising a locking tab depending from an interior region of the flap and spaced from the flap outer edge for interlocking with the container at said at least one open end.

25. The container of claim 24 wherein the sleeve, flap means and container comprise a single piece of said sheet material.

26. The container of claim 24 wherein the first flap comprises a second flap hingedly secured to the container at said at least one open end and a third flap hingedly secured to the sleeve at said one sleeve end, the second and third flaps being fixedly secured to one another in overlying relation.

27. The container of claim 26 wherein the first interlock means comprises a tab hingedly secured to the second flap.

28. The container of claim 27 wherein the inner container has opposing open ends, and further comprising a pair of said flap means each for closing said inner container at a different one of the inner container opposing open ends.

* * * * *